US008876636B2

(12) United States Patent
Rubel et al.

(10) Patent No.: US 8,876,636 B2
(45) Date of Patent: Nov. 4, 2014

(54) LACROSSE CRADLEBALL

(76) Inventors: Trevor Rubel, Bellevue, WA (US); Kiva Hartfield, Lake Oswego, OR (US)

( * ) Notice: Subject to any disclaimer, the term of this patent is extended or adjusted under 35 U.S.C. 154(b) by 280 days.

(21) Appl. No.: 13/440,082

(22) Filed: Apr. 5, 2012

(65) Prior Publication Data

US 2013/0267354 A1 Oct. 10, 2013

(51) Int. Cl.
*A63B 69/00* (2006.01)

(52) U.S. Cl.
USPC ..... 473/425; 473/446; 473/513; 473/576

(58) Field of Classification Search
USPC ..... 473/423–430, 505–508, 576, 446
See application file for complete search history.

(56) References Cited

U.S. PATENT DOCUMENTS

| | | | | |
|---|---|---|---|---|
| 2,942,883 | A * | 6/1960 | Moore | 473/424 |
| 4,127,268 | A * | 11/1978 | Lindgren | 473/576 |
| 4,867,451 | A * | 9/1989 | Mitchell | 473/576 |
| 6,976,926 | B2 * | 12/2005 | LaPointe | 473/429 |
| 7,247,107 | B1 | 7/2007 | Bedwell | |
| 2004/0009833 | A1 * | 1/2004 | Selevan | 473/576 |
| 2008/0058129 | A1 | 3/2008 | Herman | |
| 2008/0242451 | A1 * | 10/2008 | Chandless | 473/423 |
| 2009/0082141 | A1 | 3/2009 | Wilton | |
| 2009/0197711 | A1 | 8/2009 | Sommers et al. | |
| 2009/0298619 | A1 | 12/2009 | Tice | |
| 2010/0105502 | A1 | 4/2010 | Craine | |

OTHER PUBLICATIONS

B-LAX Lacrosse Rebounder; Stefan Craine; URL=http://www.b-lax.com/Lacrosse_Rebounder.html; Jan. 5, 2012; Copyright 2007-2012.

* cited by examiner

*Primary Examiner* — Mark Graham
(74) *Attorney, Agent, or Firm* — Lowe Graham Jones PLLC

(57) ABSTRACT

A lacrosse practice ball having a tether extending from the ball and attaching to a lacrosse stick to enable practicing of cradling or other short-range maneuvers is disclosed. In some embodiments, the tether extends from the ball by between 12-24 inches. The ball can have two channels passing through the middle of the ball and offset from one another by an angle, and the tether can pass through the channels. The tether forms a loop that can be knotted to secure the tether to the ball with the knot positioned within one of the channels. The practice ball can secure to any portion of the lacrosse stick using the tether.

10 Claims, 5 Drawing Sheets

LACROSSE CRADLEBALL

FIELD OF THE INVENTION

The present invention relates generally to a practice lacrosse ball having a flexible loop extending from the ball and configured to secure to a lacrosse stick.

BACKGROUND OF THE INVENTION

Lacrosse is a popular team sport in which players use a stick having a head that is strung with a loose mesh basket designed to catch and hold a lacrosse ball. The art of cradling the ball within the basket is one that requires much practice and skill. Many people enjoy practicing this sport indoors, but the standard lacrosse ball is relatively dense and hard and can cause damage to furniture and other property.

There are many existing devices for practicing lacrosse techniques. For example, the B-LAX LACROSSE REBOUNDER™ is a device having a ball with a hole, a line passed through the ball and knotted on one end, and plastic clip that engages the other end of the line and secures to a frame of a lacrosse stick. The B-LAX LACROSSE REBOUNDER™ includes a relatively complex clip and line engagement mechanism, and it is for use with a relatively long line, such as for throwing and catching a ball.

U.S. Pat. No. 7,247,107 discloses a lacrosse ball that meets generally accepted rules of construction but provides a more impact-absorbing surface than conventional lacrosse balls. The ball has a hollow interior and a resilient shell that deforms when the ball impacts a surface to lessen the physical impact when the ball strikes a breakable object, such as furniture.

U.S. Patent Application Publication No. 2008/0058129 discloses a practice aid having a rear cover portion and a flexible front cover portion including a front neck portion. The cover portion compliments the basket of a lacrosse stick so that a user can practice cradling without fear of dropping the ball from the stick.

U.S. Patent Application Publication No. 2009/0082141 discloses a lacrosse practice tethered assembly including a fastener loop, an elastic cord, and a lacrosse ball. The elastic cord is secured to the fastener loop on one end of the cord and the lacrosse ball on the second end of the cord. The cord is secured to a lacrosse ball by passing a portion of the cord through a hole in the ball and tying the loop into a knot. The length of cord between the ball and the stick is between 7-10 feet, or alternatively, between 6-12 feet.

U.S. Patent Application Publication No. 2009/0197711 discloses a lacrosse practice device having a lacrosse ball connected to a lacrosse stick with a return cord. The cord is attached to the ball by passing the cord through a bore and knotting the cord at a point on the cord. The cord is attached to the stick with a band that straps to a lacrosse stick and secures using a hook-and-loop fastener.

U.S. Patent Application Publication No. 2010/0105502 discloses a lacrosse practice or training device including a clip, a cord, and a ball attachment. The clip is plastic and secures to a frame of the lacrosse stick. The cord is attached to the ball using a bore with two different diameters: a small diameter portion that permits the cord to pass through, but prevents the knot to pass through, and a large diameter portion that permits the knot to sit within the ball. The cord is anywhere from 3-15 feet in length.

U.S. Patent Application Publication No. 2009/0298619 discloses a lacrosse training system including a lacrosse stick and a training assembly coupled to the stick. The training assembly may include a ball, an anchoring device and a tether extending between the ball and the anchoring device. The tether may be between about 8 inches and about 12 inches, or between about 6 inches to about 14 inches in length. The tether is coupled to the ball with a complicated anchor embedded partway inside the ball, and to the stick with a fastening mechanism including a bulky hook-and loop strap and a ring portion.

Despite the disclosures of the above devices, there remains a need in the art for a lacrosse practice and training device designed for practicing cradling and other short-range maneuvers such as dodges, fakes, switching hands and transitions to throws and shots, that has a secure connection between the cord and the ball and the cord and the stick that does not substantially impact the feel or behavior of the ball, and that is inexpensive to produce and simple to use.

SUMMARY OF THE INVENTION

Embodiments of the present disclosure are generally directed to a lacrosse practice ball having a first channel passing generally through the middle of the lacrosse ball between a first hole and a second hole on opposite sides of the lacrosse ball and a second channel passing generally through the middle of the lacrosse ball at a slight angle relative to the first channel and through the first hole and a third hole. The first hole and the third hole are on substantially opposite sides of the lacrosse ball. The practice ball can include a flexible line being knotted into a loop that passes through the lacrosse ball through the first hole, through the first channel, through the second hole, through the third hole, through the second channel, and again through the first hole. The flexible line is formed in a loop by a knot in the line, wherein the knot is positioned within one of the first or second channels.

In other embodiments, the present disclosure is also directed generally to a method of manufacturing a lacrosse practice ball including forming a lacrosse ball of solid rubber between 7¾-8 inches in circumference, between 5-5½ ounces in weight and which when dropped from a height of 72 inches upon concrete floor, that bounces 43-51 inches at a temperature of 65 degrees Fahrenheit. The method also includes forming a first channel in the lacrosse ball passing substantially through the middle of the ball, forming a second channel in the lacrosse ball passing substantially through the middle of the lacrosse ball and partially intersecting the first channel at least at a surface of the lacrosse ball, and positioning a flexible line through the lacrosse ball through the first channel and the second channel with the flexible line forming a loop that extends from the lacrosse ball on one side and is pulled against the surface of the lacrosse ball on an opposite side of the lacrosse ball.

In still further embodiments, embodiments of the present disclosure are also generally directed to a method for using a lacrosse practice ball including positioning a loop of a lacrosse practice ball around at least a portion of a lacrosse stick, wherein the loop extends from the lacrosse practice ball by between 12 and 16 inches. The loop passes through two intersecting channels passing through substantially the middle of the lacrosse practice ball. The method further includes passing the lacrosse practice ball through the loop and pulling the lacrosse practice ball to tighten the loop on itself with the loop secured around the portion of the lacrosse stick.

BRIEF DESCRIPTION OF THE DRAWINGS

Preferred and alternative examples of the present disclosure are described in detail below with reference to the following drawings.

DETAILED DESCRIPTION OF THE PREFERRED EMBODIMENT

Figure 1:
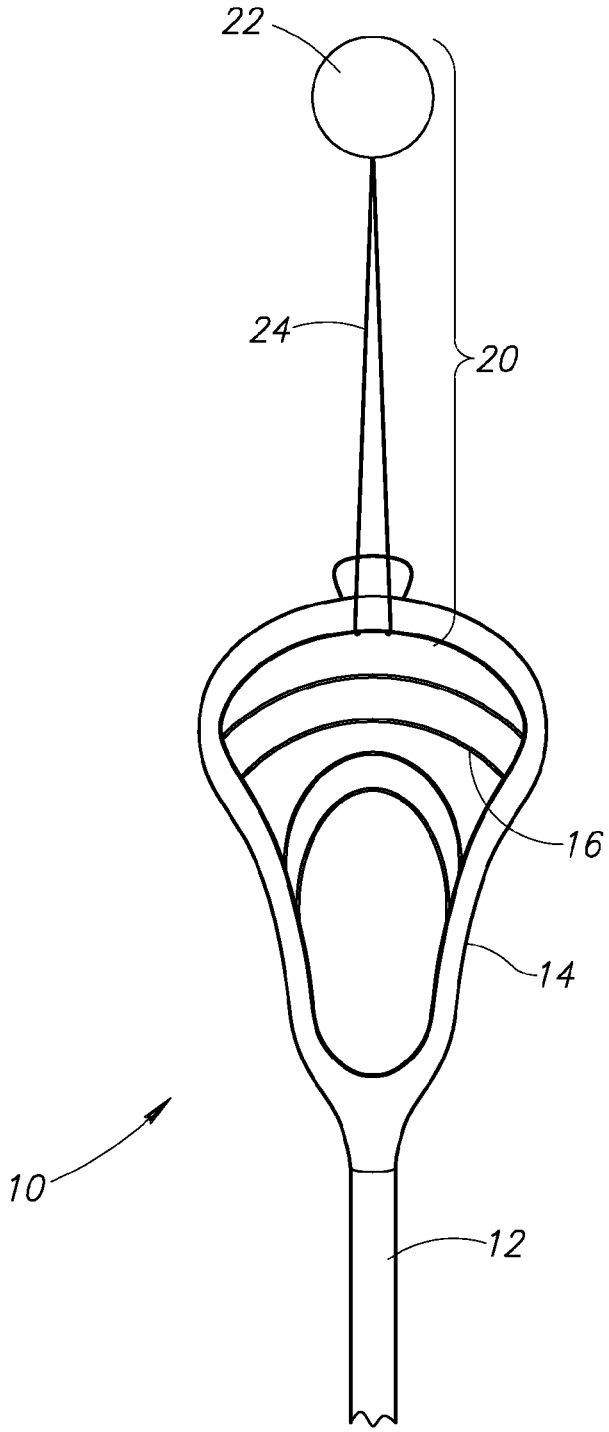
FIG. 1 illustrates a lacrosse stick and a practice ball according to an embodiment of the present disclosure.

FIG. 1 illustrates a lacrosse stick 10 and a practice ball 20. The stick 10 can include a shaft 12, a frame 14 extending from a distal end of the shaft 12, and a webbing or basket 16. The stick 10 can be a traditional lacrosse stick. The lacrosse stick 10 can be either a men's stick, having a deeper basket and comparatively more slack in the webbing 16, or a women's stick, having a shallower basket and less slack in the webbing 16. In some embodiments, the lacrosse stick 10 can be specially made to accommodate the practice ball 20, or it can be an off-the-shelf lacrosse stick.

The practice ball 20 can include a ball 22 and a tether 24 extending from the practice ball 20 and coupling to the frame 14 of the lacrosse stick 10. The tether 24 can be a thin, flexible line made of nylon, polyester, or any other suitable material. The tether 24 can simply be a line extending from the ball 22, and can be placed around any portion of the stick 10, including the shaft 12, any portion of the frame 14, or any portion of the webbing 16. The tether 24 can be a loop that extends from a single hole in the ball 22 or from two holes in the ball 22. The ball 22 can be passed through the loop in the tether 24 and pulled taught so that the tether 24 secures the ball 22 to the stick 10. In some embodiments, the tether 24 can include a clip that secures to a portion of the stick 10 and to the 24. However, in other embodiments, the tether 24 secures to the stick 10 with no additional equipment required.

Figure 2B:
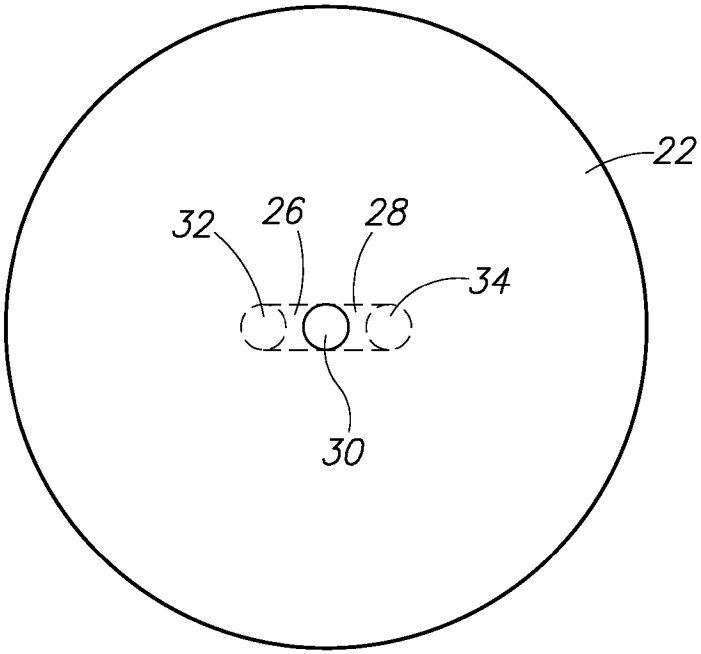
FIG. 2B is top view of the ball of FIGS. 1 and 2A according to embodiments of the present disclosure.
Figure 2A:
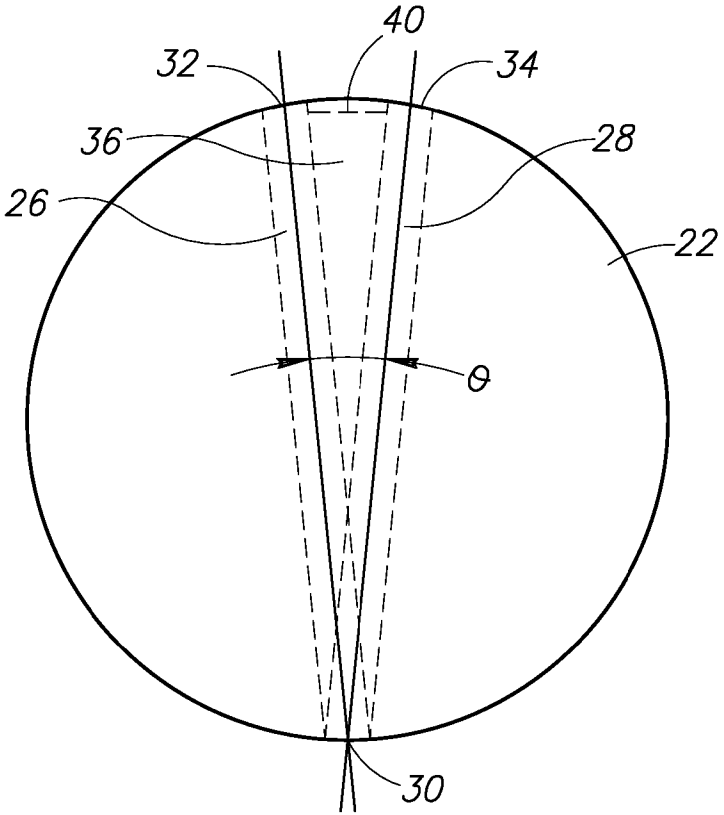
FIG. 2A is a cross-sectional side view of the ball of FIG. 1 according to embodiments of the present disclosure.

FIG. 2A illustrates a cross-sectional side view of the ball 22 according to embodiments of the present invention. FIG. 2B illustrates a top view of the ball 22. The ball 22 can be a conventional lacrosse ball according to an accepted standard, such as the standard of the NCAA issued in 2000, which states that "the ball shall be white, yellow or orange solid rubber between 7¾ and 8 inches in circumference, between 5 and 5½ ounces in weight and when dropped from a height of 72 inches upon concrete floor, shall bounce 43 to 51 inches at a temperature of 65 degrees Fahrenheit." The ball 22 can be made according to any other suitable specification.

The ball 22 can have a first channel 26 and a second channel 28 passing generally through the middle of the ball 22. The channels 26, 28 can be 3/16" in diameter. The first channel 26 can intersect the surface of the ball 22 at a first hole 30 and a second hole 32; the second channel 28 can intersect the surface of the ball 22 at the first hole 30 and at a third hole 34. The first channel 26 and the second channel 28 can intersect at least at the surface of the ball 22. As shown in this embodiment, the first channel 26 and the second channel 28 can intersect at the first hole 30. In other embodiments, the channels 26, 28 can intersect at some other intermediate position within the ball 22. The channels 26, 28 can be formed in a variety of ways. They can be drilled, punched, or pressed into an existing ball 22, or they can be molded or otherwise formed into the ball 22 as the ball 22 is being made. In other embodiments, the channels 26, 28 do not intersect, and the ball 22 can have a fourth hole (not shown). The channels 26, 28 can pass through a mid plane of the ball 22 in one dimension, such as shown in FIG. 2B. The channels 26, 28 can be angled slightly relatively to one another by an angle θ, with an intermediate portion 36 between the channels 26, 28. The dimensions of the intermediate portion 36 can vary. In some embodiments, the distance between the second hole 32 and the third hole 24 can be approximately 1 centimeter. The angle θ between the channels 26, 28 can be approximately 15° or 12°.

FIG. 2B shows the ball 22 from the side of the first hole 30. Second and third holes 32, 34 are shown in phantom, as are the first and second channels 26, 28. The relative arrangement of these holes and channels creates a wedge-shaped intermediate portion 36 that serves as the anchor for the tether 24. The size and position of the channels 26, 28 and the holes 30, 32, 34 can be altered to accommodate other applications. For example, the ball 22 can be something heavier than a lacrosse ball so the angle between the channels 26, 28 can be widened to increase the size of the intermediate portion 36 to strengthen the coupling. In other embodiments where lesser loads are expected, perhaps the angle can be narrower to reduce the distance between the second hole 32 and the third hole 34 to minimize the amount of line on the exterior of the ball 22. In some embodiments, the ball 22 can include a shallow groove 40 on the exterior surface of the ball 22 to maintain the line within the perimeter of the ball 22.

Figure 3:
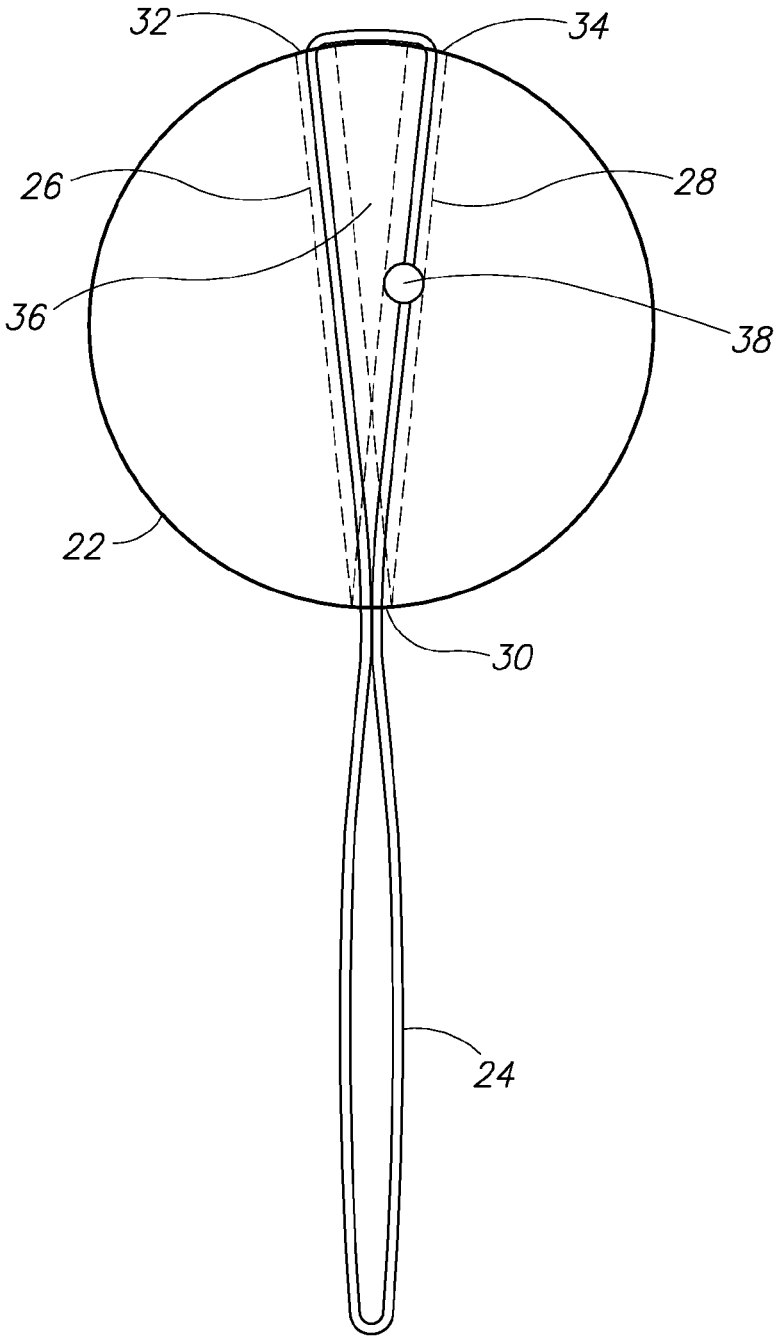
FIG. 3 illustrates a practice lacrosse ball and loop according to embodiments of the present disclosure.

FIG. 3 illustrates the ball 22 of FIGS. 1, 2A and 2B with the tether 24 attached. The tether 24 can form a loop that passes through the first hole 30, through the first channel 26, out the second hole 32, over the intermediate portion 36, through the third hole 34, through the second channel 28, and out the first hole 30 again. The loop can be formed of a single line of material and can be knotted to form the loop. After tying the knot 38, the knot 38 can be slid into the first channel 26 or the second channel 28 to protect the knot 38 and so that the tether 24 on the exterior of the ball 22 is seamless. In some embodiments, one or more of the channels 26, 28 can have a shoulder (not shown) that will prevent the knot 38 from passing but allows the unknotted line to pass. The line can therefore be easily slid through the channel 26, 28 until the knot 38 hits the shoulder. The resulting practice ball 20 is a standard size lacrosse ball 22 with a flexible tether 24 forming a loop extending from the ball 22 from a single hole (such as the first hole 30). Opposite the tether 24 a portion of the line is exposed on the intermediate portion 36 of the ball. The tether 24 can be attached to a lacrosse stick 10 as discussed above.

The tether 24 can be of virtually any length. In some embodiments the tether 24 is approximately one inch long, and is configured to be attached to a leash, a lanyard, or some other object to carry promotional indicia such as team colors, marketing materials, etc. In other embodiments, the tether 24 is between 12 inches and 20 inches from the ball 22. The tether 24 can be long enough so that the tether 24 is slack when the ball 22 is in the basket 16. As discussed above the tether 24 can be attached to the stick 10 in virtually any position on the stick 10, so depending on the attachment position the tether 24 can be longer or shorter and still be slack when the ball 22 is in any part of the basket 16. The practice ball 20 can therefore be used anywhere with little fear of causing harm to furniture or other nearby objects. The practice ball 20 excels at practicing the art of cradling the ball 22 within the basket 16 of the stick 10. In the heat of a lacrosse match it can be difficult to maintain the ball in the basket 16 as the player moves about the field at full speed. Also, opposing players try to knock the ball from the basket 16. The practice ball 20 of the present disclosure allows players to practice even indoors or when there is no one else around with which to practice. The material of the tether 24 can be pliable and flexible so that when the ball is cradled in the basket 16 and some of the tether 24 bunches up around the ball between the ball and the basket 16, the tether 24 does not substantially interfere with the feel or the behavior of the ball within the basket to closely simulate the feel of an unadorned ball. The tether 24 can be made of a material that has substantially the same surface characteristics of the ball, such as the coefficient of friction, so that using the practice ball 20 is no harder or easier to cradle than an unadorned ball. The tether 24 can also be much longer, such as 10 or 15 feet or longer, so that the player can throw the ball 22 from the stick 10 and retrieve the ball 22 using the tether 24. The tether 24 can be non-extensible, or it can be resilient.

Figure 4:
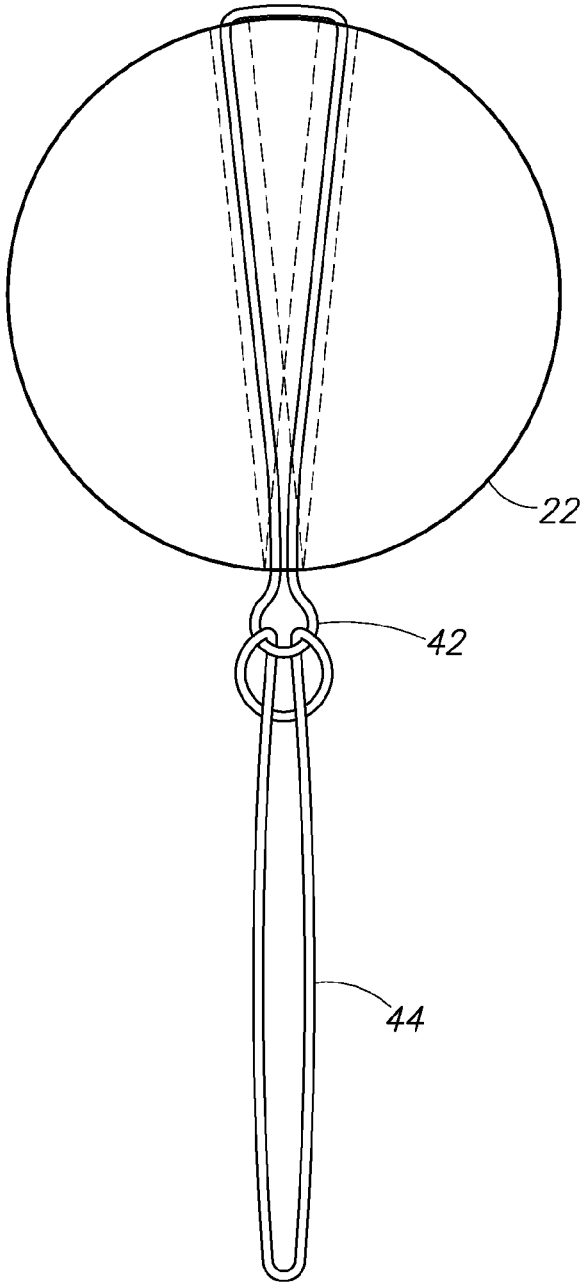
FIG. 4 illustrates a practice lacrosse ball, a first loop, and a second loop according to embodiments of the present disclosure.

FIG. 4 illustrates another embodiment of the practice ball 20 including a ball 22, a first tether 42, and a second tether 44. The first tether 24 can be substantially as described above, but can extend from the ball 22 a short distance, such as approximately one inch. The first tether 42 is configured to remain attached to the ball 22, and is configured to be attached to the second tether 44. The second tether 44 can be a tether or a leash or any other suitable device. The ball 22 can therefore be used with only the first tether 42 as a close approximation to an unadorned ball, or it can be used in connection with the second tether 44 for practice purposes as described herein. The second tether 44 can also include other promotional materials such as a keychain, a whistle, marketing indicia or any other suitable object. The second tether 44 can engage the first tether 24 in the same way the tether 24 attaches to the lacrosse stick 10 as described above by passing through itself around a portion of the first tether 42. In other embodiments, the first tether 42 and the second tether 44 can be connected by a clip or another suitable fastener.

Figure 5:
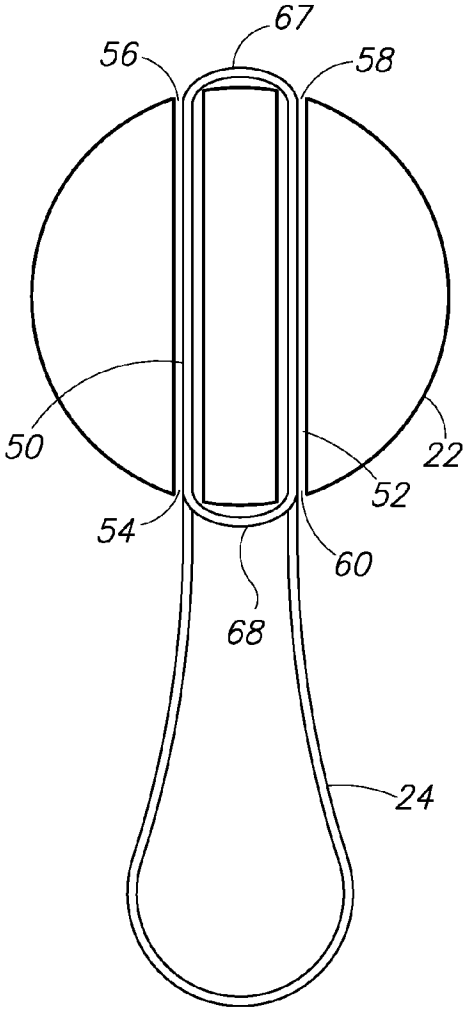
FIG. 5 illustrates a practice lacrosse ball having two non-intersecting channels according to embodiments of the present disclosure.

FIG. 5 illustrates yet another embodiment of the lacrosse practice ball of the present disclosure in which the ball 22 has two non-intersecting channels: a first channel 50 and a second channel 52. The first and second channels can be generally parallel. The first channel 50 has a first hole 54 and a second hole 56; the second channel has a first hole 58 and a second hole 60. The tether 24 can pass through the first hole 54, through the first channel 50, out the second hole 56, into the first hole 58, through the second channel 52, and out the second hole 60. One end 67 of the tether 24 can be pulled against the surface of the ball 22 and the other end can be pulled away from the ball 22 for use with a lacrosse stick as described elsewhere herein. The tether 24 can be looped around the portion of the ball between the channels two or more times, and one or more of the loop sections 68 can be pulled tight against the ball 22 opposite the end 67 of the tether 24.

Figure 6:
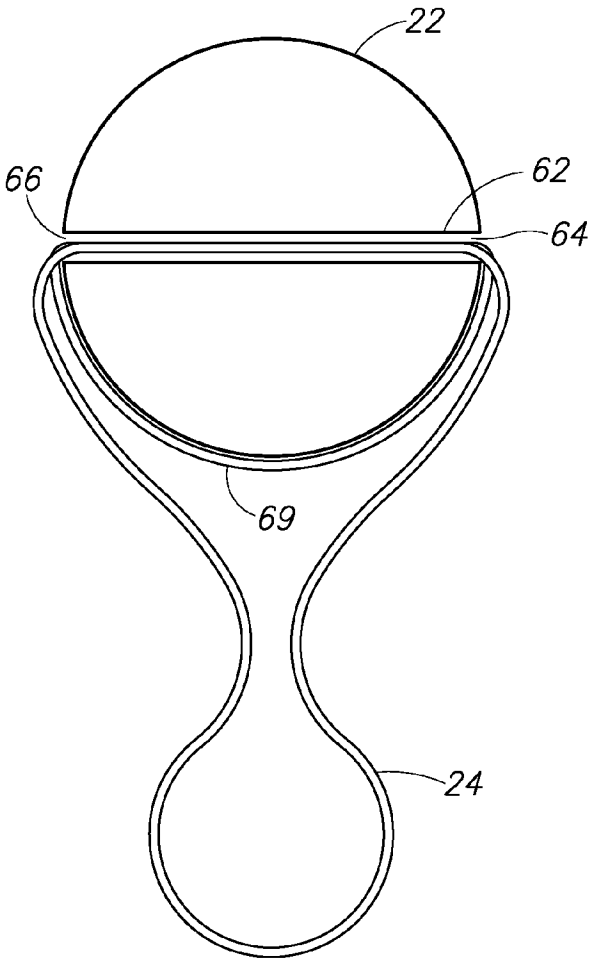
FIG. 6 illustrates a practice lacrosse ball having a single channel according to embodiments of the present disclosure.

FIG. 6 illustrates still another embodiment of the present disclosure in which the ball 22 has a single channel 62, having a first hole 64 and a second hole 66. The line 24 can be passed through the channel 62 and secured to a lacrosse stick as described elsewhere herein. Also, the tether 24 can be passed through the channel 62 two or more times with at least one of the sections 69 pulled taut against the surface of the ball 22 between the first hole 64 and the second hole 66.

While the preferred embodiment of the invention has been illustrated and described, as noted above, many changes can be made without departing from the spirit and scope of the invention. For example, the tether 24 can be a single line, and it can be attached to the ball using a screw, an embedded washer, or by another type of clip or fastener. Accordingly, the scope of the invention is not limited by the disclosure of the preferred embodiment. Instead, the invention should be determined entirely by reference to the claims that follow.

The invention claimed is:

1. A lacrosse practice ball, comprising:

a lacrosse ball having a first channel passing generally through the middle of the lacrosse ball between a first hole and a second hole on opposite sides of the lacrosse ball and a second channel passing generally through the middle of the lacrosse ball at a slight angle relative to the first channel and through the first hole and a third hole, wherein the first hole and the third hole are on substantially opposite sides of the lacrosse ball; and a flexible tether being formed into a loop, wherein the flexible tether passes through the lacrosse ball through the first hole, through the first channel, through the second hole, over an intermediate portion of the ball, through the third hole, through the second channel, and again through the first hole, wherein the flexible tether is formed in a loop by a junction point in the tether; and wherein the flexible tether is configured to be positioned around at least one of a portion of a lacrosse stick or a portion of a webbing of the lacrosse stick with the ball passing through the loop and pulled taut, such that the lacrosse practice ball extends from the lacrosse stick by a distance substantially equal to the length of the loop and the lacrosse practice ball is secured to the lacrosse stick using only the flexible tether.

2. The lacrosse practice ball of claim 1 wherein the junction point is positioned within one of the first or second channels.

3. The lacrosse practice ball of claim 1 wherein the flexible tether is pulled tight against the intermediate portion of the ball between the second hole and the third hole.

4. The lacrosse practice ball of claim 1 wherein the flexible tether extends from the first hole in the lacrosse ball by between 12 and 24 inches.

5. The lacrosse practice ball of claim 1 wherein the flexible tether is made of a thin, flat material.

6. The lacrosse practice ball of claim 1 wherein the second hole and third hole are spaced apart by approximately ½ inch.

7. The lacrosse practice ball of claim 1 wherein the flexible tether extends from the ball by approximately one inch, and wherein the flexible tether is configured to attach to a leash.

8. The lacrosse practice ball of claim 1 wherein the lacrosse ball is solid rubber between 7¾-8 inches in circumference, between 5-5½ ounces in weight and which when dropped from a height of 72 inches upon concrete floor, bounces 43-51 inches at a temperature of 65 degrees Fahrenheit.

9. The lacrosse practice ball of claim 1 wherein the first and second channels are angled relative to one another by between approximately 12° and 15°.

10. The lacrosse practice ball of claim 1, wherein the flexible tether is positioned around at least one of a portion of a lacrosse stick or a portion of a webbing of the lacrosse stick with the ball passing through the loop.

* * * * *